United States Patent [19]

Ceriani

[11] 4,207,636

[45] Jun. 17, 1980

[54] CUSHION CONSTRUCTION

[75] Inventor: Julius J. Ceriani, Freeland, Pa.

[73] Assignee: Tenneco Chemicals, Inc., Saddle Brook, N.J.

[21] Appl. No.: 720,926

[22] Filed: Sep. 27, 1976

[51] Int. Cl.[2] ..... A47C 27/15

[52] U.S. Cl. ..... 5/481; 5/434

[58] Field of Search ..... 5/337, 338, 339, 355, 5/361 R, 361 B

[56] References Cited

U.S. PATENT DOCUMENTS

| | | | |
|---|---|---|---|
| 3,319,272 | 5/1967 | Eller | 5/338 |
| 3,335,435 | 8/1967 | Marsh et al. | 5/361 R |
| 3,403,414 | 10/1968 | Unger | 5/361 R |

FOREIGN PATENT DOCUMENTS

| | | | |
|---|---|---|---|
| 1078656 | 8/1967 | United Kingdom | 5/337 |
| 1273259 | 5/1972 | United Kingdom | 5/337 |

*Primary Examiner*—Kenneth Dorner

*Attorney, Agent, or Firm*—Thomas E. Spath; James P. Scullin

[57] ABSTRACT

This invention relates to a new construction for upholstered seat cushions and backs for chairs and sofas, for throw pillows and the like, wherein a resilient, flexible foam material such as polyurethane foam or latex foam rubber, having a convoluted front and rear surface is provided with a wrapping of a batt or web of a very soft and resilient non-woven fibrous material prior to being covered in the conventional manner with a fabric.

6 Claims, 5 Drawing Figures

CUSHION CONSTRUCTION

BACKGROUND OF THE INVENTION AND THE PRIOR ART

This invention relates to pillows and bedding and in particular to loose or removable cushions used as seats and backs in upholstered chairs and sofas. These loose or removable cushions are distinguished in the art from the type of cushioning or stuffing which is tied down, nailed or glued to the sofa or chair frame before being covered and upholstered as an integral part of the sofa.

The use of various types of resilient flexible foamed material for furniture cushions, throw pillows, bedding and the like is well known in the art, and such materials as latex foam rubber, and more recently polyurethane foam, were adopted for such uses as soon as the products became commercially available.

The use of soft and resilient non-woven fibrous products either alone or in conjunction with the resilient flexible foam material in the manufacture of seat and back cushions is also well known in the prior art. Thus, raw cotton batting has been used to fill out and provide additional rounded contour to blocks of polyurethan foam used in loose chair and sofa cushions. With the development of numerous synthetic non-woven fibrous materials, most of which have superior resiliency and tensile strength properties, these materials have been used in place of the cotton batting. These non-woven fibrous materials are commonly referred to as fiberfill in the industry. More recently, thin gauged polyurethane foam peelings, i.e., from 50 to 125 mils, have found use in conjunction with, or as substitutes for the soft non-woven fibrous batting materials.

In the design and manufacture of furniture having loose seat and back cushions the nature of the cushioning material effects the overall cost of the piece, as well as the subjective factors of appearance and comfort, both initially and after prolonged use. Cushions containing fiberfill alone while attractive and soft to the initial touch, provide little support when compared to foam, are easily crushed and are very expensive to produce.

Polyurethane foam alone provides neither the initially soft feel associated with fiberfill, nor its inviting appearance. The batting wrapped polyurethane foam cushion known to the prior art is inferior to the present invention because it provides too firm a final support and as the batting becomes crushed through use, little initial comfort. Moreover, when a batt of fiberfill material is wrapped around a single piece of foam for use in chair or sofa back cushions it often has a tendency to settle and slip from the position of its original installation. This slipping and settling results in a loss of the tailored look of fullness originally present in the cushions, in many instances after a relatively short period of use.

BRIEF DESCRIPTION OF THE INVENTION

What has been found is that when a resilient, flexible foam block is provided with a convoluted front and rear surface and wrapped with a relatively thin layer of a soft non-woven fibrous material such as non-woven polyester fiber, a cushioning product is obtained which has superior appearance and performance characteristics. The resulting cushion when covered with fabric or other upholstering material is comparable in appearance and comfort to a cushion filled with non-woven polyester fiberfill alone, and has the advantage of being much less expensive for the same finished thickness. More importantly, not only is the cushion of the invention as comfortably soft initially as one containing polyester fiberfill alone, it retains during use that soft richness and tailored look for a far longer period of time.

The batting wrapped around the convoluted foam core after usage tends to layer among the peaks of the convolutions, thus remaining uncrushed longer. This construction provides a higher comfort factor since depressing the composite cushion from ten to twenty percent of its uncompressed thickness results in compression of essentially only the batting over a substantial part of the surface area. The convolutions on both the front and back surfaces of the cushions provide a sensation of floating comfort to the user even when the cushion is fully compressed since the back convolutions being spread out over a wider area of contact with the supporting chair or sofa construction provide softness even though the full firmness of the foam core itself exists.

DETAILED DESCRIPTION OF THE INVENTION

The invention will be more fully and completely discussed and understood with reference to the following drawings.

Figure 1:
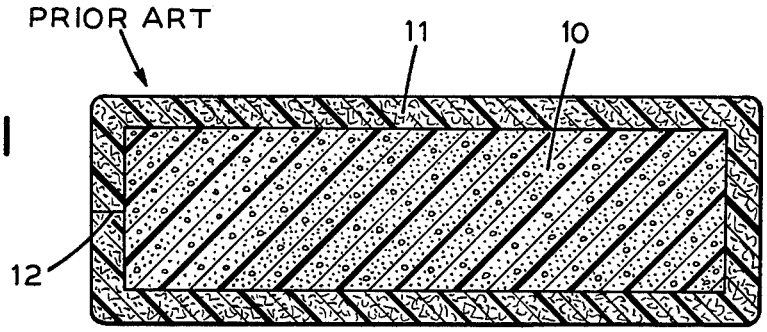
FIG. 1 is a side view of a cushion constructed in accordance with the prior art.

In the construction of the fiberfill wrapped cushions of the prior art, as shown in FIG. 1, a rectilinear foam core 10, is wrapped with a batt of non-woven fibers 11, the ends of which are joined at 12 by stitching or adhesive, or are merely overlapped.

Figure 2:
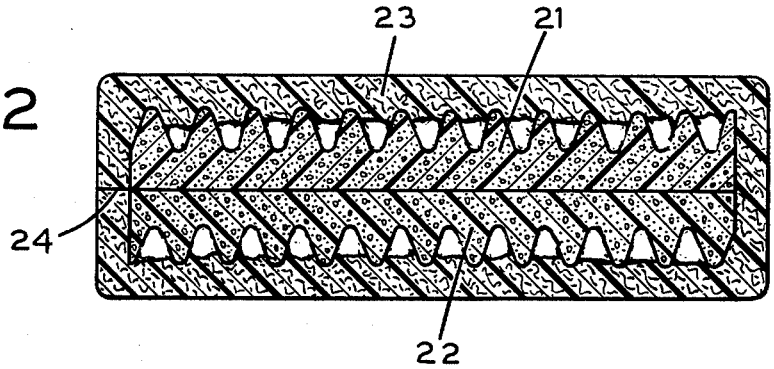
FIG. 2 is a cross-section of a cushion constructed in accordance with the present invention.

In the practice of the invention foam blocks of the desired pre-determined dimensions are passed through conventional apparatus to provide blocks which have a convoluted upper surface and a smooth back surface. These blocks are then cut to produce a core of a size suitable to obtain the desired outer dimensions of the pillow, sofa or chair seat or back cushion. As shown in FIG. 2 a pair of these convoluted blocks 21 and 22 are then put together back-to-back leaving the convoluted faces exposed, and then wrapped with a quantity of resilient non-woven fibrous material 23 which is sufficient to provide the desired exterior contour and fullness to the finished upholstered cushion product. If desired for reasons of foam material availability or the need to produce cushions of unusually large thickness an additional foam block having flat surfaces can be inserted between the two convoluted blocks. The blocks can be cemented together with a suitable adhesive in order to facilitate their subsequent handling and wrapping. Suitable adhesives are known in the art and include organic solutions or aqueous emulsions of rubber, polyvinyl chloride, polyvinyl acetate and their copolymers; polyurethanes, acrylates, starches; proteins and 100% (neat) adhesives such as hot melts from polyamides or from ethylene-vinyl acetate copolymers.

The types of resilient flexible foam material which are in use in the furniture and bedding manufacturing industry, and which are suitable for use in producing the convoluted foam cores of the invention include latex foam rubber, polyurethane foam, both polyester and polyether, and vinyl foams. Because of its ready availability from numerous sources, relative economy and its desirable properties, a polyester polyurethane type of foam is preferred in the practice of the invention.

The depth of the convolutions in the outer surfaces of the foam core are determined at least in part by the thickness of the individual pieces making up the cushion. For ease and economy of manufacture and fabrication the thickness of each piece of smooth-backed convoluted foam will be one-half of the overall foam thickness desired. Thus, if the cushion is to contain a foam core of a nominal thickness of five and one-half inches each piece will measure two and three-quarter inches from the top of the foam lands to the smooth back. Satisfactory results have been obtained with convolutions ranging in depth from 17% to 80% of the total thickness of the foam core. The preferred range for cushions having an overall thickness of from five to six inches is to provide convolutions having a depth in the range of from 25% to 75%.

Figure 3A:
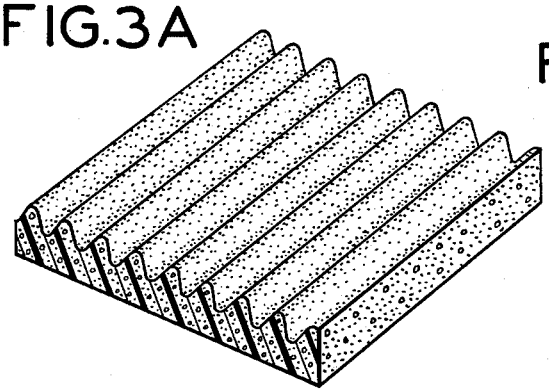
FIGS. 3A–3C show in cross-section a number of typical convoluting patterns which may be employed in practicing my invention.
Figure 3B:
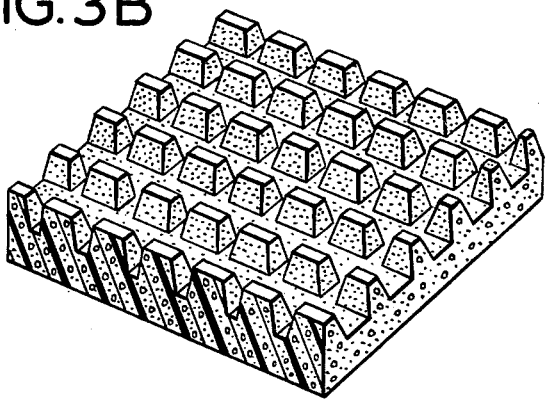
Figure 3C:
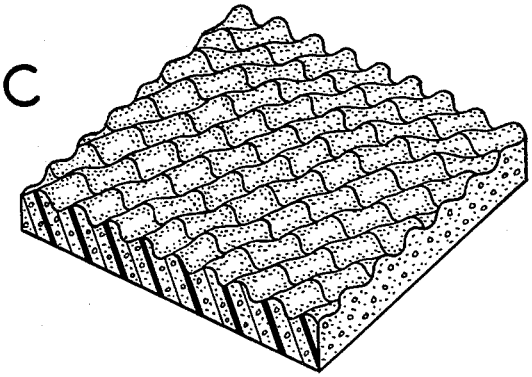

Although any of the various patterns for the convoluted foam surface shown in FIG. 3 are suitable for use in the practice of the invention those of 3B and 3C are preferred as having geometrically uniform patterns without regard to the orientation of the cushion face.

Various soft non-woven fibrous materials exhibiting high loft, such as the polyester material sold under the trademark Dacron 91 by the DuPont Company, are especially useful in the practice of the invention. Because of its popularity and widespread availability of polyester fiberfill to the united States furniture industry, the examples described below have been directed to the use of this particular product. However, as will be apparent to anyone possessing any degree of skill in this art, any number of other similar non-woven, high loft fibrous products such as nylon, rayon, cellulose acetate and the like which have comparable properties can be substituted.

The polyester fiberfill batting used for wrapping the convoluted foam core should give good loft and bulk support with a mimimum of weight. To maintain the integrity of the non-woven fibers for use and handling the batts are commercially sold either in bonded form, using a resin, or are sewn to a light-weight cloth cover. Sewn batting commonly employs cheesecloth on one or both sides of the fiberfill and costs substantially more than the unsewn batting. While the fiberfill batting of the bonded or unsewn type, or either of the sewn types can be used in the practice of the invention, the unsewn material is preferred for reasons of economy.

The quantity of non-woven resilient fibrous material to be applied about the resilient flexible foam block will be readily apparent to one skilled in the art or can be determined without undue experimentation, as that quantity which is necessary when put into the pillow covering or upholstery material to provide a tailored look and the desired fullness to the finished article. Batts of polyester fiberfill material are commercially available in uncompressed thickness of from about one-half to three inches. In the practice of the invention, a polyester fiberfill batt ranging in thickness from one to two inches is preferred. A satisfactory density for the one-inch material is approximately ¾ of an ounce per square foot.

The fiberfill batt 23 shown in FIG. 2 can be wrapped about the convoluted surfaces of the foam core in a single layer of the desired thickness, or multiple layers can be wrapped to build up to the desired thickness. Where at least one outer layer of cheesecloth is sewn to the batting this can be hand-stitched at 24 following wrapping to facilitate further handling of the cushion, and its stuffing into the final cover. As an alternative to stitching, the ends of the batting can be butted together as shown in FIG. 2 and joined with a suitable adhesive. This type of butt seam is preferably located along one of the edges of the core rather than on a convoluted surface.

The principal advantages to be achieved from the invention is a cushion which has superior softness and comfort, which maintains its luxurious appearance during a longer period of use and which is much more economical to produce than either cushions containing fiberfill alone, or those containing a smooth foam core wrapped with fiberfill batting. It is believed that these advantages are obtained in the novel construction of the invention as a result of the interaction between the non-woven fiberfill and the peaks and valleys of the convoluted surface of the foam core. The convoluted surface has the ability to hold the non-woven fibers batting in place and prevent slipping and sagging. It also provides in conjunction with the fiberfill, a surface area that combines a close and gradually varying pattern of supporting regions with pockets of the softer material.

Various combinations of plain and convoluted resilient flexible foam cores wrapped with resilient non-woven fibrous batts were constructed and subjectively tested for appearance and comfort, but none was found to provide the superior performance as that of the present invention. In order to obtain subjective criteria for the purposes of comparing various cushion constructions, samples are prepared by cutting 20" by 20" blocks from the same ether-based flexible polyurethane foam material and wrapping each with a single one-inch thickness of non-woven polyester fiberfill batting having a density of ¾ ounce per square foot. The ends of the batting are joined with adhesive and without overlapping. The samples are of the following constructions:

Sample 1: Unconvoluted foam 5½ inches thick.

Sample 2: Foam 5½ inches thick convoluted one side only, Pattern 3B of FIG. 3.

Sample 3: Foam 2¾" thick two pieces back-to-back, convoluted back and front, Pattern 3B of FIG. 3.

Sample 4: Two pieces 2¾" thick single convoluted foam, peaks in same direction, Pattern 3B.

Sample 5: Same two pieces as in Sample 4 with peaks meshed into other's valleys, (i.e. nested).

When the above samples were laid flat and gradually compressed against a firm surface by hand, Sample 1 feels least comfortable because the initial softness is quickly replaced by a feeling of firmness so that if hand pressure is applied quickly and forcefully, all that is felt is firmness, substantially as though the foam were not wrapped with any fiberfill batting. Product of Sample 5 substantially duplicates the feel of Sample 1. When the product of Sample 2 is tested with peaks toward the pressing hand, the initial sensation of softness tends to last longer as the hand gradually presses down and a sensation of firmness does not come as quickly when the hand presses down either gradually or forcefully. When product of Sample 2 is tested with peaks pointed toward a flat unyielding surface, a wobbly sensation is felt rather than one of comfort. The wobbly feeling and lack of either comfort or firmness are even stronger when the product of Sample 4 is tested (with both sets of peaks simultaneously pointed in the same direction)

regardless of whether they are pointed up or down. Product of Sample 3, which can be tested from either side, gives better initial softness than any of the others, a richer feeling of comfort as the hand comes down and no hardness to the firming as the hand comes down forcefully.

A further subjective comparison is made between sample cushions measuring 20" by 20" constructed as follows:

Sample 6: Laminate of 1-inch thick unconvoluted supersoft polyester urethane foam to 3-inch thickness of foam of earlier examples using no batting.

Sample 7: Two pieces of convoluted foam each 2" thick back-to-back, Patterns 3A in FIG. 3, no batting.

Sample 8: Same as Sample 7 but wrapped with a single 2" thickness of polyester fiberfill batting.

Despite the fact that the product of Sample 8 is far more massive than the other two, it produces a much softer feel for a longer period of time as additional pressure is applied to it so that even when the cushion is forcefully hand compressed there was no final "bottoming out" felt.

What is claimed is:

1. In a furniture cushion designed to be covered for use, comprising a core of resilient flexible foam material wrapped with at least one layer of a batt of resilient non-woven fiberfill material, the improvement which comprises providing the foam core with front and rear convoluted surfaces which are wrapped with a batt of said fiberfill material from one to two inches thick and ranging in density from ¾ of an ounce to two ounces per square foot, which results in improved seating comfort and improved retention of shape and tailored look after extended use.

2. The cushion of claim 1 in which the core is a polyurethane foam.

3. The cushion of claim 1 in which the foam core is constructed from two pieces of foam, each of which has a convoluted upper surface and a flat back surface, by placing the pieces back-to-back.

4. The cushion of claim 1 wherein the convolutions on each of the foam core surfaces range in depth from 25% to 75% of the total thickness of the foam core.

5. The cushion of claim 1 wherein the fiberfill batt is a resin bonded high loft polyester material.

6. The cushion of claim 5 wherein the ends of the fiberfill batt are adhesively joined without overlapping.

* * * * *